US005720135A

United States Patent [19]

Paquette

[11] Patent Number: 5,720,135

[45] Date of Patent: Feb. 24, 1998

[54] PREFABRICATED MODULAR VEHICLE PARKING STRUCTURE

[75] Inventor: John E. Paquette, Foster City, Calif.

[73] Assignee: Modular Steel Systems, Inc., Reno, Nev.

[21] Appl. No.: 263,181

[22] Filed: Jun. 21, 1994

[51] Int. Cl.[6] ..... E01F 9/00

[52] U.S. Cl. ..... 52/174; 52/263; 52/650.3; 52/783.19

[58] Field of Search ..... 52/174, 175, 265, 52/650.1, 650.3, 653.1, 783.19, 236.6, 236.7, 236.9

[56] References Cited

U.S. PATENT DOCUMENTS

| | | | |
|---|---|---|---|
| 1,986,999 | 1/1935 | Burgess | 52/174 |
| 2,698,974 | 1/1955 | White | 20/1.13 |
| 3,066,771 | 12/1962 | Wolchuck | 52/783.19 X |
| 3,505,768 | 4/1970 | Bentley | 52/174 |
| 3,831,329 | 8/1974 | Lear | 52/126.1 |
| 3,971,179 | 7/1976 | Bodorsi et al. | 52/223.1 |
| 4,800,694 | 1/1989 | Sasaki | 52/650.3 X |
| 4,922,670 | 5/1990 | Naka et al. | 52/263 X |
| 5,079,890 | 1/1992 | Kubik et al. | 52/263 X |
| 5,177,913 | 1/1993 | Erel | 52/79 |
| 5,331,781 | 7/1994 | Gilbert | 52/174 X |
| 5,408,790 | 4/1995 | Hoesten et al. | 52/263 |

OTHER PUBLICATIONS

"A Revolutionary Concept in Parking Structures", Portable Parking Structures, International, 1968.

"Portable Modular Parking Structure", Harding–AFG, Inc. Parking Systems, 1991.

*Primary Examiner*—Carl D. Friedman

*Assistant Examiner*—Beth A. Aubrey

*Attorney, Agent, or Firm*—Flehr Hohbach Test Albritton & Herbert LLP

[57] ABSTRACT

A vehicle parking structure is disclosed which is comprised of prefabricated, modular components for portability. At the parking location, a steel framework is erected with a grid of support beams which form a plurality of bays. Each bay mounts a metal deck panel which is formed of a deck structure having an undulating cross-section, the top of which carries a flat rigid plate. The deck structure and plate provide a combined moment of resistance sufficient to support the weight of vehicles parked on top of the deck panels. Layers of elastomeric materials are applied over the deck panels for providing a waterproof, non-skid, wear resistant contact surface for the vehicles.

4 Claims, 4 Drawing Sheets

PREFABRICATED MODULAR VEHICLE PARKING STRUCTURE

BACKGROUND OF THE INVENTION

1. Field of the Invention

This invention relates in general to portable parking structures. More particularly, the invention relates to parking structures comprised of modular components which can be prefabricated and transported for erection at a parking location.

2. Description of the Related Art

Portable parking structures have been provided in the prior art. In many urban areas there is a demand for parking space because of the heavy vehicular traffic, especially by commuters. Municipalities and other government authorities have sought to resolve this problem by erecting portable parking structures in that they are less expensive than permanent structures and permit the structures to be temporarily erected on vacant city lots. Another advantage is that the structures, because they are portable, can be leased to the governmental agency which could otherwise not afford the capital costs of a more permanent structure.

Prior art portable parking structures include those in which a steel frame is first erected and then pre-cast concrete slabs are set in place over the frame to form the upper level of parking. An example of this type of parking structure is disclosed in U.S. Pat. No. 3,505,768 to Bentley which utilizes pre-cast concrete slabs to form the deck surfaces. U.S. Pat. No. 5,177,913 to Erel discloses a multi-level parking lot in which concrete modular elements are fitted together to form parking compartments. The concrete modular elements provide the weight-bearing function.

The parking structure designs as exemplified by the Bentley and Erel patents have not found acceptance by municipalities and governmental agencies. One important reason for this is the heavy weight of the concrete slabs or modules. In the case of the Bentley patent, the heavy concrete slabs increase the requirements for the structural steel of the supporting frame, and also require large foundations. As a result, the heavy concrete slabs, steel framework and foundation for the structure are more difficult and costly to build and erect.

U.S. Pat. No. 2,698,974 to White shows a steel frame multi-deck parking rack. The steel frame has metal plate surfaces for supporting the automobile tires. Because of the complexity of this structure, it is relatively more expensive and lacks portability.

The need has been recognized for a portable parking structure which obviates the foregoing and other limitations and disadvantages of the prior art parking structures. Despite the various parking structures in prior art, there has not yet been provided a suitable and attractive solution to these problems.

SUMMARY OF THE INVENTION

The present invention provides a parking structure formed of prefabricated modular elements which are portable and can be easily and rapidly erected at a parking location. A plurality of deck panels are mounted within bays formed by a grid of support beams which are mounted across the tops of upright columns. Each deck panel is comprised of a deck structure formed of metal components that combine to provide a relatively large moment of resistance so that the weight of the vehicles can be supported when they are parked on top of the deck panels. The deck panels include one or more surface layers of elastomeric material over which the vehicles can be driven and parked. The parking structure is relatively inexpensive, its components can be readily transported to the erection site, it can be rapidly erected using simple tools, and the assembled structure is relatively light-weight so that the requirement to provide large foundations for the columns is minimized.

The foregoing and additional objects and features of the invention will appear from the following specification in which the preferred embodiments have been set forth in detail in conjunction with the accompanying drawings.

DESCRIPTION OF THE PREFERRED EMBODIMENTS

Figure 1:
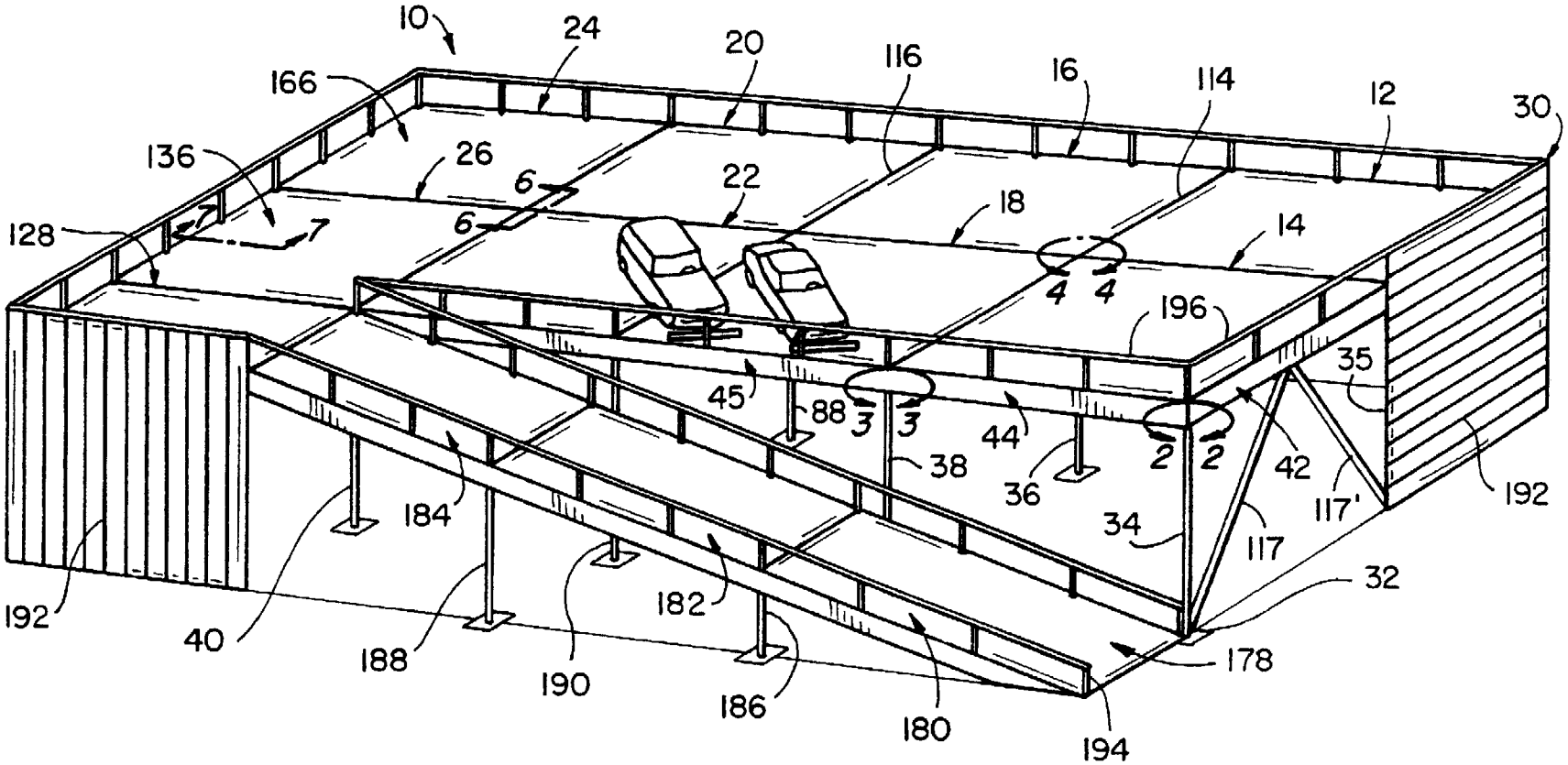
FIG. 1 is a perspective view of a vehicle parking structure in accordance with a preferred embodiment of the invention.

In the drawings FIG. 1 illustrates generally at 10 a prefabricated and portable parking structure in accordance with a preferred embodiment of the invention. Parking structure 10 has an upper deck comprised of a plurality of preassembled modular deck panels 12–28 which are mounted in situ onto a steel framework 30 that is erected at the desired parking location.

Prior to erection of the framework, concrete footings 32 are buried in the ground at the locations of respective vertical columns 34–40. Each concrete footing can be a 2'×2' cube with a pre-embedded top steel plate, not shown. Each column comprises a steel pipe, preferably 3½" diameter, that is mounted upright with its lower end secured to the top plate of each footing by suitable means such as bolts.

Figure 2:
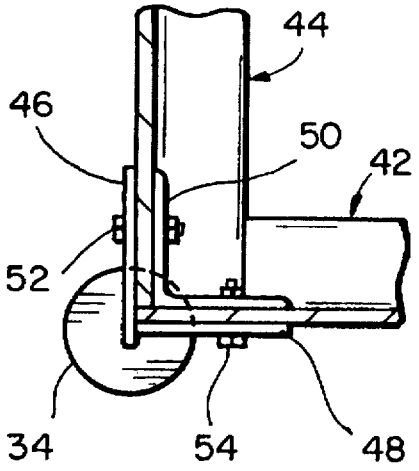
FIG. 2 is a fragmentary horizontal cross-sectional view taken on the line 2—2 of FIG. 1.

Framework 30 further includes perimeter support beams comprising C-shaped channels 42–44, with the channels preferably having a vertical depth of 12". The adjacent ends of the two channels at each of the four corners of the framework are mounted to the upper ends of the upright corner columns by the arrangement shown in FIG. 2 for the typical column 34. A pair of upright steel mounting plates 46, 48 are welded together to form an L-shaped angle which is welded to the top of the column. The vertical web portion at the end of one channel is formed with a notch (not shown) to fit with a corresponding notched tab (also not shown) formed in the end of the other channel. The notch and tab fit in the manner of a mortise and tenon joint so that the two channel ends butt together at the corner. The corner formed by the two channels is then placed atop column 34 and fitted into the angle formed by plates 42 and 44. An L-shaped angle 50 is then fitted inside the corner formed by the channels, and bolts 52, 54 are mounted through aligned bolt-holes to releasably connect the channel ends to the angles and column.

Figure 6:
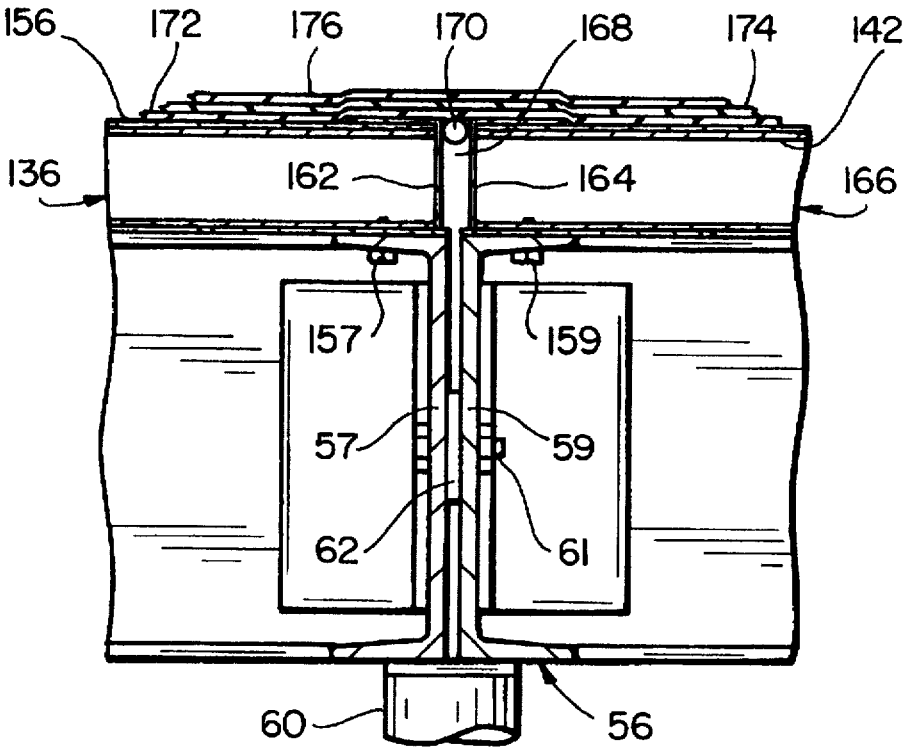
FIG. 6 is a fragmentary vertical cross-sectional view taken along the line 6—6 of FIG. 1.

Along the longitudinal axis of the parking structure a row of axially aligned I-beams 56, 60 and 70 are provided. As best shown in FIG. 6 for the location above post 60, the typical I-beam 56 comprises two 12" deep C-shaped channels 57, 59 bolted back-to-back by bolts 61. These I-beams span across the tops of the interior row of columns 36, 58 and 60. The I-beams at opposite ends of the structure are secured to the perimeter channels 42 in a manner similar to that described below in connection with FIG. 3. At each bolt location a ⅜" metal spacer 62 is fitted between the channels so that they are spaced apart when bolted together. This spacing is sized to fit about upright mounting plates 88 and 90 at the "X" joint, as explained below in connection with FIG. 4.

Figure 3:
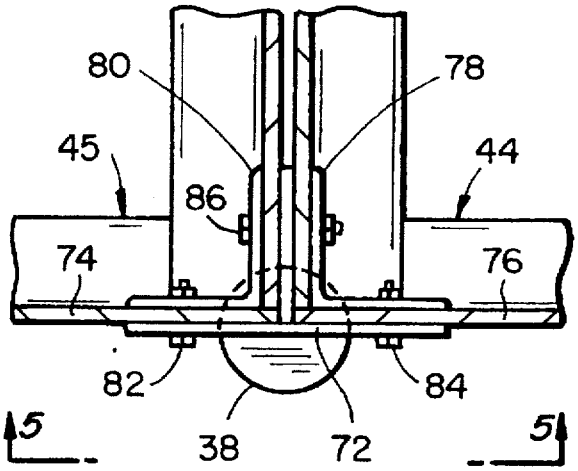
FIG. 3 is a fragmentary horizontal cross-sectional view taken along the line 3—3 of FIG. 1.

A plurality of 12" deep cross I-beams 66–70, which can be C-shaped channels bolted back-to-back, are oriented orthogonal with the perimeter channels 44 and longitudinal I-beams 56. The cross I-beams are connected by the arrangements illustrated in FIGS. 3–5. FIG. 3 shows the arrangement for making a "T" connection between the cross I-beam 66 and perimeter channels 44 and 45. An upright longitudinal mounting plate 72 is welded across the top of column 38. The ends of the back-to-back C-channels forming I-beam 66 are fitted against the vertical webs 74, 76 at the adjacent ends of the perimeter channels, the outer faces of which abut against mounting plate 72. An angle 78 is then fitted against the inside corner formed by the webs of channels 44 and 66, and another angle 80 is fitted against the inside corner formed by the webs of channels 45 and 66. Bolts 82–86 are then mounted through aligned bolt-holes for releasably connecting the channels to the mounting plate and angle and thereby to column 38.

Figure 4:
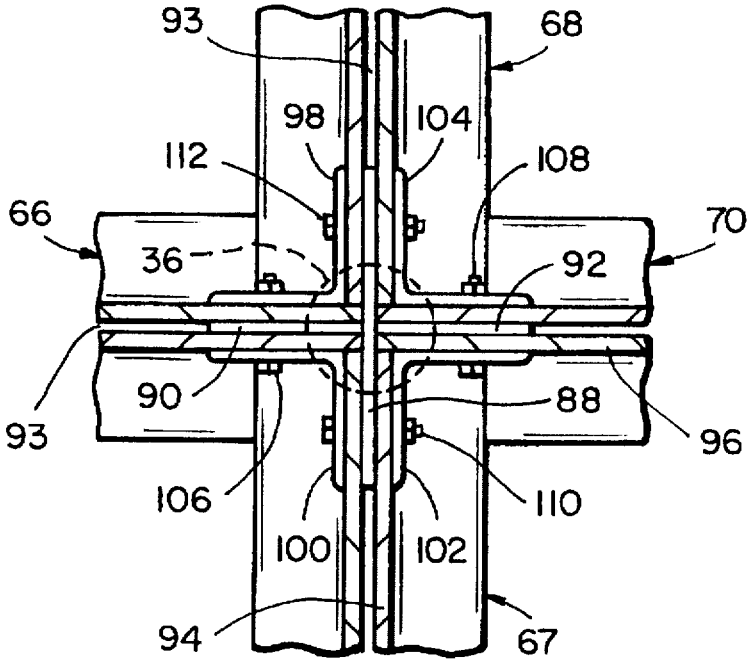
FIG. 4 is a fragmentary horizontal cross-sectional view taken along the line 4—4 of FIG. 1.
Figure 5:
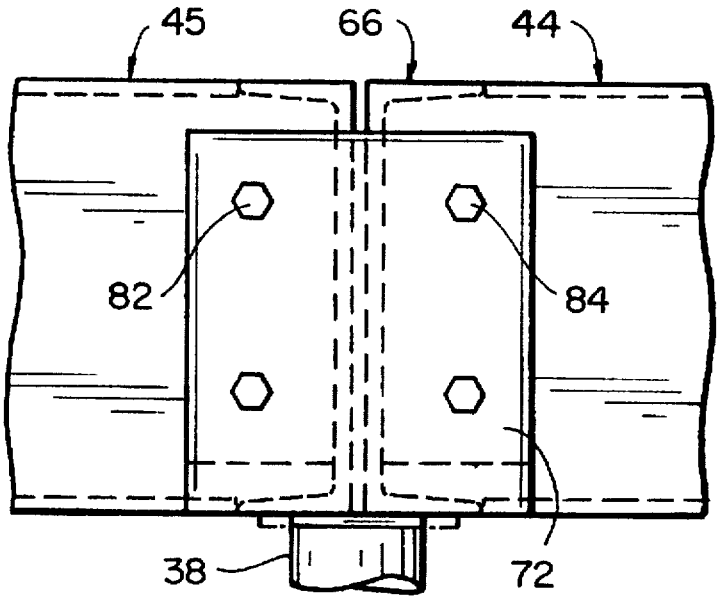
FIG. 5 is a fragmentary side elevational view taken along the line 5—5 of FIG. 3.

FIG. 4 illustrates the details of the method of connecting the cross I-beams 67 and 68 to the longitudinal I-beams 66 and 70 at the "X" joint formed at a typical one of the center locations of the framework. An upright steel mounting plate 88 is welded across the top of column 36 centered with the longitudinal axes of cross I-beams 67 and 68. A pair of upright steel mounting plates 90 and 92 are then welded to the top of the column orthogonal with plate 88. The three plates thereby form four right-angle corners. The ends of the I-beams are mounted above the column with the spacing 93 between the channel webs fitting about the mounting plates. The corner formed by the webs 94, 96 of C-channels 67, 70 fit into one of the corners formed by the mounting plates. Similarly, the corners formed by the webs of the other C-channels at this mounting location fit into the remaining corners formed by the mounting plates. Four angles 98–104 are then fitted into the interior corners of the webs formed by the channels, and bolts 106–112 are fastened through aligned bolt-holes to releasably connect these channels to the mounting plates and angles and thereby to the column.

The perimeter channels and grid of longitudinal and cross I-beams combine to form a plurality of bays 114, 116 in a reticulated pattern. Preferably the peripheral shapes of the bays are squares of 20'×20' dimensions. The bays could also be rectangular, as desired. The peripheral margins of the deck panels 12–28 are shaped commensurate with the bays so that each panel preferably is a 20'×20' square.

Cross-bracing is mounted as required to strengthen framework 30. For example, a pair of cross braces 117, 117' extend diagonally from the lower end of adjacent columns to the center upper end of the intermediate beam 42.

Figure 7:
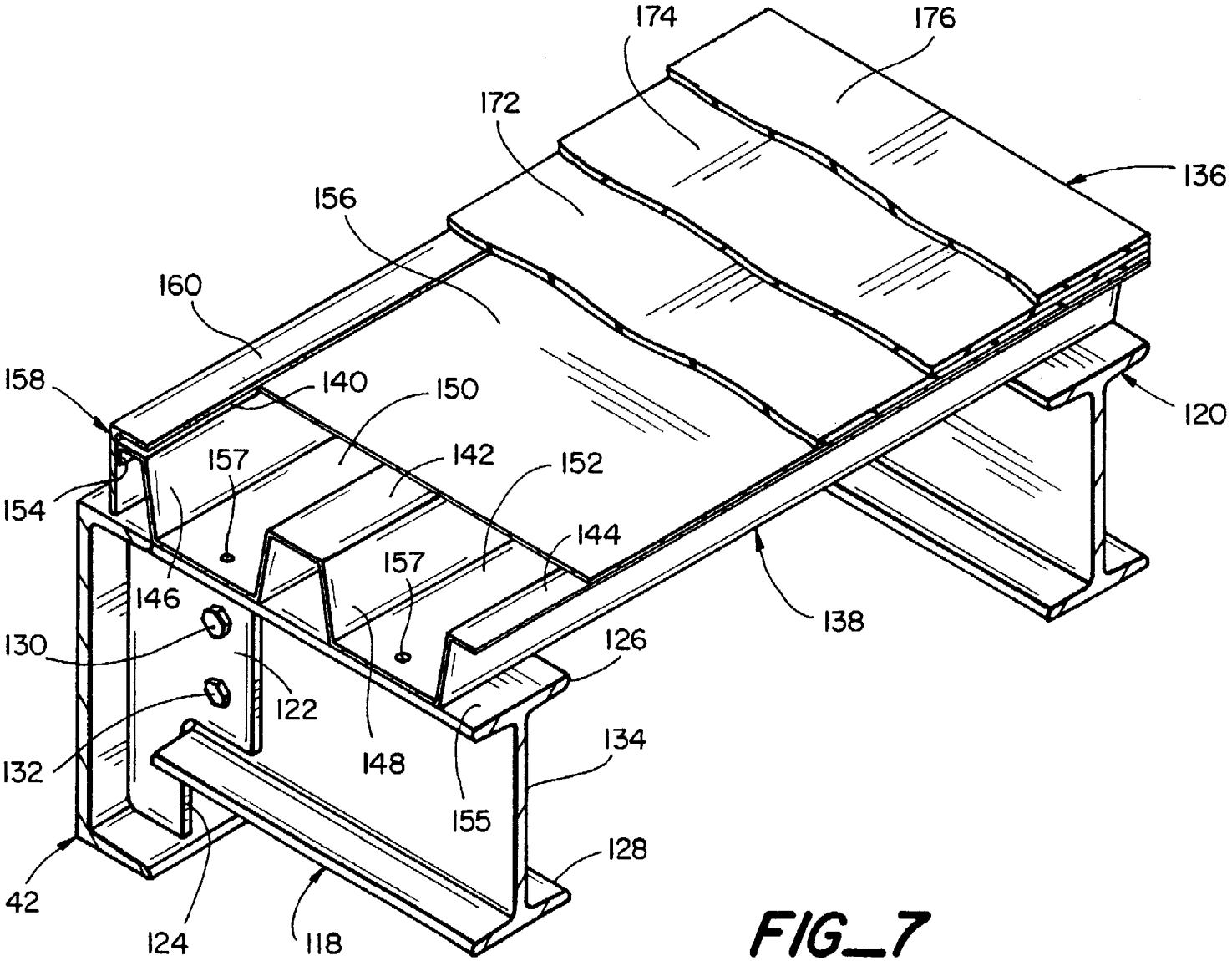
FIG. 7 is a fragmentary perspective and sectional view taken along the line 7—7 of FIG. 1.

Additional support for the deck panels is provided by a plurality of I-beams which are mounted in spaced-apart relationship across each bay. Preferably the I-beams are 8" deep, and each bay has two of these beams in parallel relationship. FIG. 7 shows the pair of 8" I-beams 118, 120 spanning across a typical bay at the perimeter of the structure. The means for connecting the 8" I-beams to the perimeter channel 42 for the typical beam 118 comprises an upright mounting plate 122 which is welded to the inside of the channel at each I-beam location. Notches 124 are formed in the plate to accept the upper and lower flanges 126, 128 of the I-beam. Bolts 130, 132 are then mounted through aligned bolt-holes extending through plate 122 and web 134 of the I-beam. The opposite or interior end of the 8" I-beams are similarly bolted to mounting plates, not shown, on the facing channels of the I-beam at the opposite end of bay.

FIG. 7 illustrates details of the construction of the typical deck panel 136. The deck panel is comprised of a formed metal deck structure 138, preferably of 16 gauge steel. The deck structure has an undulating cross-sectional shape forming a plurality of laterally spaced land portions 140–144 which are alternatively positioned between and integrally joined through web portions 146, 148 with a plurality of laterally spaced trough portions 150, 152. The deck structure of each panel is comprised of ten 2' wide by 20' long deck sections, each of which has three trough portions and four land portions. One side of each 2' section is formed with a downwardly turned interlocking edge 154. The opposite side of the section is formed with an upwardly turned interlocking edge, not shown, which locks with the upturned edge of the adjacent deck section. Each 2' deck section can advantageously be a 2' wide roof deck of the type conventionally used in building construction where the trough portions are on top and the land portion are on bottom. In such conventional use, metal reinforcing bars are typically placed in the spaces formed between the web portions and then concrete is poured around the reinforcing bars and over the top of the trough portions. In the present invention, such deck sections are inverted so that the trough portions are on bottom, and the reinforcing bars and concrete are not utilized.

Each deck panel 136 further comprises a set of rigid plates 156 which are mounted across the flat upper surfaces of the land portions of the deck structure. The plates 156 are comprised of ten 2'×20' 16 gauge steel plates, which are secured as by welding to the land portions of each 2'×20' deck section 138. With the ten deck sections assembled together, the metal plates form a combined 20'×20' rigid plate structure. The cross-sectional shape of the deck structure together with the rigid plates provide a combined moment of resistance, also termed the stress moment, which is sufficiently large to support the weight of vehicles parked on top of the deck panel. Each 20'×20' deck panel is shop fabricated and then shipped for erection at the parking location.

With framework 30 assembled, the deck panels are lifted and dropped onto respective bays 114, 116. As best shown in FIG. 7, the trough portions 150, 152 of the deck structure rest upon the flat horizontal surfaces of the upper flanges of the I-beams, for example surface 155 on upper flange 126 of I-beam 118. These portions of the upper flanges of the I-beams in the bays thereby bear substantially the entire vertical load of the deck panels and any vehicles which are supported by the deck panels. Suitable fasteners 157, 159 (FIGS. 6 and 7), preferably screws, are mounted from below through holes in the upper flanges of the 8" deep I-beams 118–120 to releasably secure the deck panels against sideways movement. Because it is the I-beams and not the fasteners which carry the vertical loads, the fasteners can be relatively small, permitting them to be more easily installed and removed.

A L-shaped closure plate 158 is mounted along each side of the perimeter of the deck panel. The inwardly projecting upper lip 160 of the closure plate is secured to the outer land portion 140 of the deck structure by suitable means such as welding.

When the deck panels are mounted on their bays, the closure plates 162, 164 of the typical adjacent deck panels 136, 166 are separated by a gap 168, as best shown in FIG. 6. These gaps are closed off by caulk tubes 170 which are mounted between the upper ends of the facing closure plates. The caulk tubes prevent water from seeping down between and into the deck panels, which would otherwise cause premature deterioration.

After the deck panels are in place, the upper surfaces of the rigid plates 156 are coated with layers of elastomeric materials. The first layer 172 comprises a water-proof base coat which is spread in liquid form over the plates and then allowed to harden. Next the second layer 174 comprising a wear coat is spread in liquid form over the base coat, and the wear coat then allowed to harden. The upper layer 176 is formed by spreading a top coat material in liquid form which then is allowed to harden over the wear coat. The three layers are also spread over the upper lips 160 of the closure plates around the perimeters of the panels as well as over the caulk tubes 170 between the panels. The material of the base coat advantageously can be the synthetic polymer sold under the brand name Vulkem 350 by Mameco International Inc. of Cleveland, Ohio. The wear coat can be the polymer material sold under the brand name Vulkem 345 and the top coat can be the polymer material sold under the brand name Vulkem 346, both sold by Mameco International Inc. The top coat can be embedded with sand to simulate concrete and provide a non-skid surface. The overall thickness of the three layers can be in the range of 63 to 90 mils. When installed, the three layers provide a deck coating which is non-skid, waterproof and wear resistant.

An inclined access ramp 178 is provided at one side of framework 30. The access ramp comprises a plurality, shown as three, of modular deck panels 180–184 of the type described for the panel 136 of FIG. 7. A suitable concrete retaining wail, not shown, is constructed to support the lower end of panel 180. A pair of upright posts 186, one of which is shown, supports the upper end of panel 180 as well as lower end of middle panel 182. Another pair of upright posts 188, 190 supports the upper end of the middle ramp as well as the lower end of upper ramp 184, the top end of which is connected to panel 28 on the top deck. The parking structure is completed by attaching a suitable facade 192, which is optional, around the framework. Suitable metal clips, not shown, are attached to sides of the outer deck panels to connect with the upper ends of the facade. The lower ends of the facade can be supported on a suitable concrete curb, not shown, built around the perimeter of the framework. Railings 194, 196 can then be installed along the access ramp as well as the sides of the outer deck panels.

The parking structure of the present invention provides a number of important advantages. The preassembled modular deck panels and other components are sufficiently small and light weight so that they are portable and can be quickly erected at the parking location. Assembly of the components at the parking location can be accomplished using simple tools and fasteners such as screwdrivers, wrenches, bolts and screw fasteners. No welding operations are required during in situ erection. A typical parking structure incorporating the invention can be erected in about two weeks as compared to the time of about two months that would be required to build the foundation for and erect a parking structure employing concrete slabs.

The advantage of portability with the parking structure of this invention makes it suitable for temporarily use. It can be easily and rapidly dismantled and moved to other locations as land use requirements change. The portability of the structure also permits it to be leased to municipalities, for example, which would thereby not have to absorb the relatively high capital costs involved in purchasing or building permanent structures, such as concrete parking facilities.

The metal deck panels have a configuration which enables the assembled panels to support the heavy weight of parked automobiles, as well as heavy snows, such as snow loads of up to 100 lbs./ft.$^2$.

In the invention the weight of the modular deck panels is relatively less than the weight of prior art parking structures with concrete deck slabs. Thus, in the invention the weight of the parking structure, including deck panels and framework, is less than 17 lbs./ft.$^2$. In comparison, with parking structures having concrete slabs of 8" thickness weighing 100 lbs./ft.$^2$, then the total weight of the structure, including framework, would be in the range of 125 to 130 lbs./ft.$^2$. As a result, such prior art parking structures would require much larger foundations. In the heavier structures with concrete slabs, it would normally be required to drive piles into the ground to support the structure. The requirement to drive piles for the foundation is expensive and time consuming. The lighter weight of the parking structure in the present invention thus makes it better adapted for use at sites where the ground conditions are less stable, such as those with poor landfill.

The parking structure of the present invention is also more earthquake resistant. Because of the use of ductile steel for construction of the framework and deck panels, as well as the lighter weight construction, the structure can ride with earth motions. This is in comparison with the prior art concrete structures which tend to crack and fail during earthquakes. The parking structure of the present invention exceeds the earthquake code seismic 4 standards, which are the conditions expected in the worst earthquake areas such as San Francisco, Calif.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A prefabricated modular vehicle parking structure for erection over a parking location, the parking structure comprising the combination of: a plurality of columns mounted upright in spaced-apart relationship at the parking location, at least a pair of first metal support beams, at least a pair of second metal support beams, connecting means for connecting the first and second support beams onto selected ones of said columns with the first pair of beams extending orthogonally with the second pair of beams to form a bay therebetween, said first support beams are each comprised of a vertical web and horizontal upper and lower flanges formed on opposite edges of the web, said bay having a predetermined peripheral size and shape, at least one deck panel comprised of a metal deck structure having an outer peripheral edge which is sized and shaped substantially commensurate with the peripheral size and shape of said bay, said deck panel comprising an undulating plate having a plurality of parallel, generally U-shaped portions together with top portions which interconnect adjacent pairs of the U-shaped portions, a rigid metal plate extending across and secured to said top portions with void spaces being formed between said U-shaped portions and the top plate, said deck structure together with the rigid plate providing a combined moment of resistance which is at least sufficient to support the weight of vehicles parked on top of the deck panel, and mounting means for mounting the deck panel on said bay, said mounting means comprising means for positioning said deck panel on said bay with the deck structure resting on a portion of said upper flanges for bearing a substantial portion of the vertical load of the deck panel and any vehicles which are supported by the deck panel.

2. A parking structure as in claim 1 in which said mounting means comprises fastener means for releasably fastening said trough U-shaped portions onto certain of said support beams.

3. A parking structure as in claim 1 in which said deck panel further comprises a least one surface layer of an elastomeric material mounted over the rigid plate with the surface layer providing a contact surface for the vehicles.

4. A parking structure as in claim 1 in which said mounting means further comprises fastener means for releasably fastening said deck structure against sideways movement relative to said support beams.

* * * * *